US008522763B2

(12) United States Patent
Nebergall

(10) Patent No.: US 8,522,763 B2
(45) **Date of Patent: *Sep. 3, 2013**

(54) COMPOUND ARCHERY BOW

(76) Inventor: Dirk Nebergall, Sanford, FL (US)

( * ) Notice: Subject to any disclaimer, the term of this patent is extended or adjusted under 35 U.S.C. 154(b) by 226 days.

This patent is subject to a terminal disclaimer.

(21) Appl. No.: 12/932,561

(22) Filed: Mar. 1, 2011

(65) Prior Publication Data

US 2012/0222662 A1 Sep. 6, 2012

(51) Int. Cl.
*F41B 5/10* (2006.01)

(52) U.S. Cl.
USPC ..... 124/25.6

(58) Field of Classification Search
USPC ..... 124/25.6, 900
See application file for complete search history.

(56) References Cited

U.S. PATENT DOCUMENTS

| | | | | |
|---|---|---|---|---|
| 428,912 | A | 5/1890 | Holmes | |
| 2,714,377 | A | 8/1955 | Mulkey | |
| 4,458,657 | A | 7/1984 | Stockmar | |
| 4,756,295 | A | 7/1988 | Guzzetta | |
| 5,205,269 | A | 4/1993 | Guzzetta | |
| 5,535,727 | A | 7/1996 | Helmuth | |
| 5,638,804 | A | 6/1997 | Remick | |
| 6,055,974 | A | 5/2000 | Dieziger | |
| 6,698,413 | B1 | 3/2004 | Ecklund | |
| 7,201,161 | B1 | 4/2007 | York | |
| 7,637,256 | B2 * | 12/2009 | Lee | 124/25.6 |
| 2003/0084893 | A1 | 5/2003 | Andrews | |

OTHER PUBLICATIONS

International Search Report and Written Opinion dated Jun. 8, 2012 in International Application No. PCT/US2012/026963, Filed Feb. 28, 2012.

* cited by examiner

*Primary Examiner* — Kurt Fernstrom
*Assistant Examiner* — Amir Klayman
(74) *Attorney, Agent, or Firm* — Rankin, Hill & Clark LLP

(57) ABSTRACT

The present apparatus is for a compound spring loaded archery bow and especially to an improved compound spring loaded archery bow having pre-adjustments for the compression spring and positioning of the compression spring housing to accommodate different archers.

26 Claims, 3 Drawing Sheets

COMPOUND ARCHERY BOW

BACKGROUND OF THE INVENTION

The present invention relates to a compound, spring loaded archery bow and especially to an improved compound spring loaded archery bow having pre-adjustments for the compression spring and positioning of the compression spring housing to accommodate different archers.

The traditional archery bow is comprised of a riser having a hand grip and an arrow rest and a pair of resilient limbs attached to each end of the riser. The resilient limbs of the bow form a resilient spring. The bow string is attached to the free end of each resilient limb so that when the bow string is drawn back from its initial position by an archer to shoot an arrow, the resilient limbs flex to place the bow string under tension. The further the archer draws the bow string back, the more the resilient limbs of the bow are flexed which imparts greater tension to the bow string. When the bow string is released to shoot an arrow, the resilient limbs of the bow snap back to their original position to force the bow string back to its initial position to propel the arrow towards a target. These traditional bows are frequently made of strong composite materials but they do have drawbacks. For instance, once an archer selects a particular archery bow, he is restricted with that bow to a maximum drawing force so that the archer is unable to vary the poundage range for a particular bow.

A compound archery bow uses a levering system and typically has cams and pulleys on the limbs. The limbs which act as a release spring in a compound bow are usually much different than those of a traditional archery bow. Stiffness makes the compound bow more energy efficient than other bows so that they are too stiff to be drawn with a string attached directly to them. A compound bow attaches a bow string to cams or pulleys to give a mechanical level to the bow string. Thus, when you pull the cables on a compound bow, it causes the cams to rotate to bend the limbs of a bow. A compound bow has a rigid handgrip or riser having limbs attached to each end and have the sights and the like attached thereto.

Prior art compound bows have typically used limbs that form leaf springs while other compound bows have used other springs for loading the bow. An earlier spring loaded archery bow can be seen in the D. M. Holmes U.S. Pat. No. 428,912 in which each limb of the bow is connected to a central coil spring passing through a tube to give the back bow increased power. In U.S. Pat. No. 4,458,657 to Stockmar, a compound archery bow is a complicated structure with both a main frame and a handle grip and a bow string tensioning assembly located forward of the main frame. The bow string tensioning assembly is formed by exposed resilient tubes for tensioning the bow string which are stretched and placed in tension when the bow string of the bow is drawn.

In the York U.S. Pat. No. 7,201,161, a compound spring loaded archery bow has separate upper and lower spring tensioning assemblies and cam mechanisms for applying tension to the bow string of the bow. Separate upper and lower spring tensioning assemblies are contained within the upper and lower rigid limbs of the bow so that the bow retains the appearance of a traditional archery bow. In the Dieziger U.S. Pat. No. 6,055,974 a compound bow has a facilitated draw for allowing a bow string to be more easily drawn and uses a pair of coil springs. In the L. J. Mulkey U.S. Pat. No. 2,714,377, an archer's bow uses a pair of coil springs. The Guzzetta U.S. Pat. No. 4,756,295 is a compound bow which uses a toggle-like assembly to improve the accuracy and acceleration of the bow. It utilizes a single coil spring.

The present archery bow is spring loaded with a pair of coiled springs mounted to each limb of the bow, which coil springs are pre-adjustable for both pull and which also allows the spring housings to be adjusted for a particular archer.

SUMMARY OF THE INVENTION

A compound spring loaded archery bow has a riser having a handle portion with a grip thereon and a rigid limb attached to each end thereof. A spring housing is slidably mounted on the end of each limb and has a compression spring located in each housing. A crank is rotatably attached to each spring housing for rotation thereon and includes a crank arm having one end positioned against one end of the spring for compressing each spring when the crank is rotated. Each crank arm may have a roller on the end thereof for reducing friction on a spring cap covering the end of the coil spring when compressing and expanding the spring. The lever arm is attached to each crank and extends therefrom. A cam is rotatably attached to each lever arm for rotation thereon. A bow string is attached to each cam and extends therebetween for rotating each cam and each lever arm and crank to compress both compression springs when the bow string is pulled back for shooting an arrow. Each lever arm may be two lever arms forming a yoke for holding the rotatable cam therein. Timing cables are connected between the cams to synchronize the cams. The compound bow may have a threaded compression adjustment in each coil spring housing for preadjusting the compression of the spring therein. Each spring housing is slidably mounted in the end of one limb and can be locked in position for adjusting the position of the spring housing and cams for different users of the compound bow. The compound bow rotates a pair of cams and a pair of cranks to compress a pair of compression springs when shooting an arrow, which compression springs may be pre-adjusted for compression and in which the spring housings may be adjusted for different users.

BRIEF DESCRIPTION OF THE DRAWINGS

Other objects, features, and advantages of the present invention will be apparent from the written description and the drawings in which.

DESCRIPTION OF THE EXEMPLARY EMBODIMENT

Figure 1:
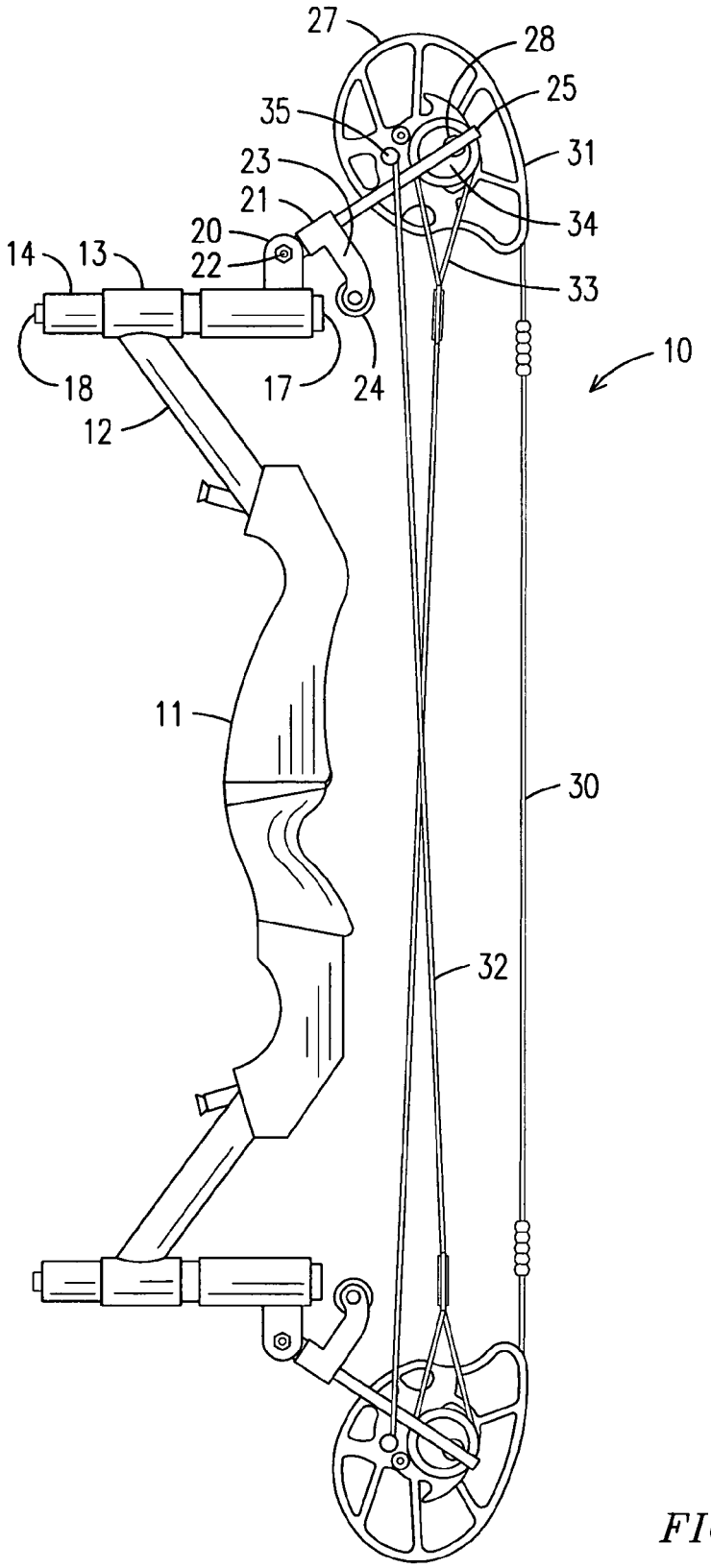
FIG. 1 is a side elevation of a compound bow in accordance with the present invention.
Figure 4:
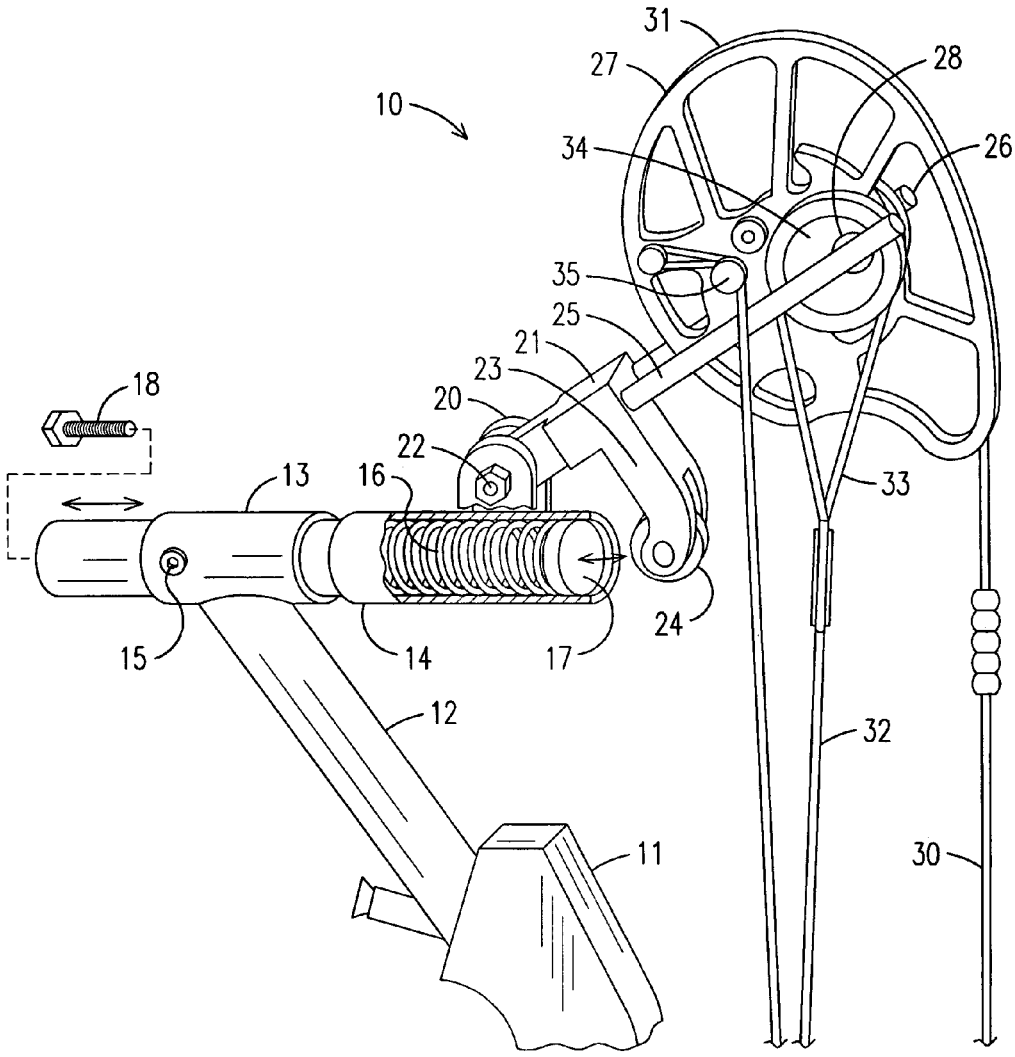
FIG. 4 is a partial cutaway perspective view of the compound bow of FIGS. 1 through 3.

Referring to FIG. 1, a compound archery bow 10 has a riser 11 which is a central mount for the components of the bow and includes a handgrip for gripping the bow. The riser 11 has a limb 12 at each end thereof rigidly attached thereto. Each limb has a cylinder 13 attached to the end thereof, which cylinder has a spring housing 14 slidably positioned therein. The slidable spring housing may be locked in position with a lock down threaded screw 15, as seen in FIG. 4. The spring housing 14 has a coil spring 16 mounted thereinside having an end cap 17 on one end thereof and also having a threaded bolt 18 at one end of the spring housing 14, which threaded bolt can be threaded in or out to pre-compress the coil springs 16.

Each spring housing 14 has a yoke 20 rigidly attached thereto which has a crank 21 rotatably attached within the yoke 20 by an axle bolt 22. The crank 21 is in a generally L-shaped configuration with an arm 23 having a roller 24 mounted on the end thereof and aligned so that rotation of the crank 21 in the yoke 20 attached to the spring housing 14 will drive the arm 23 in the roller 24 against the spring cap 17 to compress the coil spring 16. Each crank 21 has a pair of lever arms 25 and 26 attached thereto and extending therefrom and has a cam 27 attached thereto with a shaft 28 extending between the arms 25 and 26 to rotatably hold the cam 27 therein. A bow string 30 is attached to each cam and wraps around a camming surface 31 so that pulling on the bow string 30 will rotate the cams 27 as well as pull the lever arms 25 and 26 and rotate the crank 21. The crank 21, arm 23 roller 24 is pushed against the coil spring cap 17 to compress the spring 16 to put a coil spring load onto the bow string 30. A pair of timing cables 32 extend between the pair of cams 27, each cable at one end having a loop 33 formed therein which attaches around a pulley 34 on each cam with the other end of each cable pinned with a pin 35 to the side of the cam 27.

Figure 2:
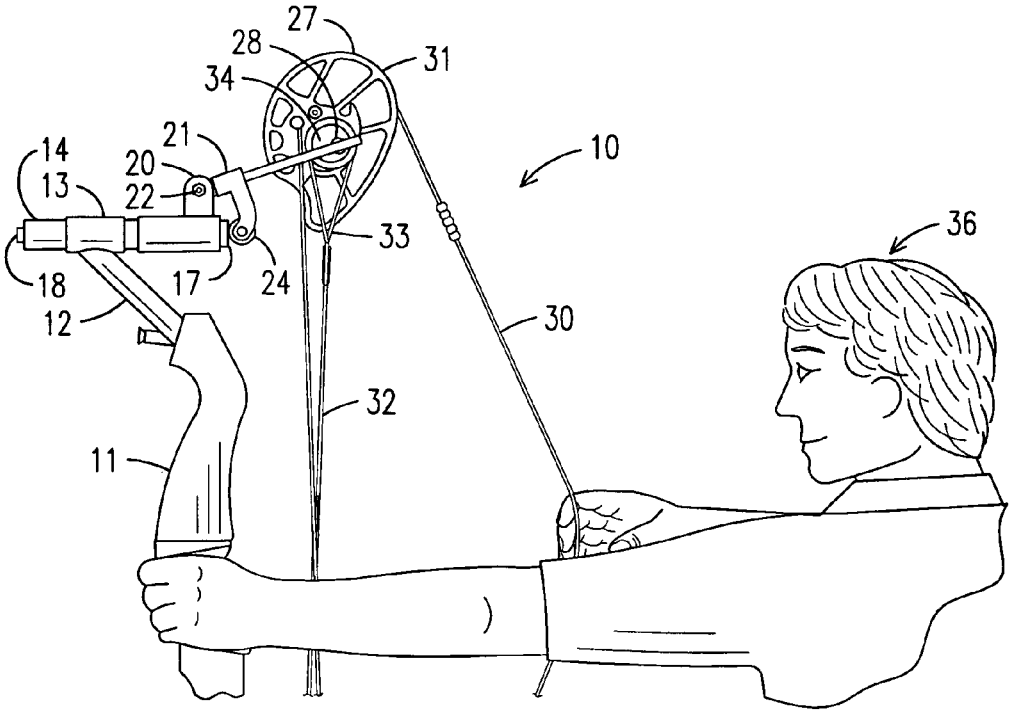
FIG. 2 is a side elevation of an archer pulling the bow string of the bow of FIG. 1.
Figure 3:
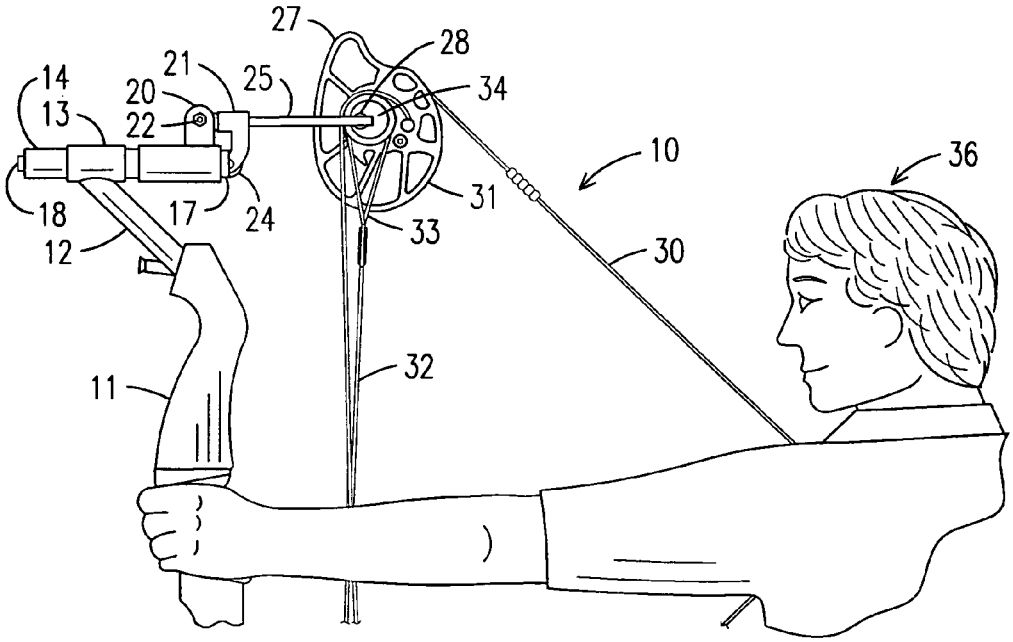
FIG. 3 is a side elevation in accordance with FIG. 2 in which the archer has further extended the bow string.

In operation, an archer, as seen in FIGS. 2 and 3, pulls the bow string 30 which begins to rotate a pair of cams 27 and which rotates the arms 25 and 26 to rotate the crank 21 which drives the roller 24 against the cap 17 to compress the spring in the spring housing 14. Drawing the bow string 30, as seen in FIG. 3, further rotates the cam 27 to further compress each coil spring 16 for shooting an arrow from the bow 10. Since each archer 36 has a different physical built, the present compound bow is easily adjustable by loosening each lock down screw 15 to slide each spring housing 14 in and out of its sleeve 13 on the end of each limb 12 to adjust the bow for a particular archer. In addition, the coil spring 16 can be pre-adjusted by threading the pre-adjustable screw 18 into or out of the end of the spring housing 14 to adjust the compression of the coil spring 16 to adjust the amount of pull required on a bow string 30 by a particular individual archer 36.

It should be clear at this time that a compound spring loaded archery bow has been provided which advantageously can be adjusted for individual archers both in terms of the positioning of the bow string relative to the riser and limbs as well as adjusting the force required to pull the bow string. However, the present invention is not to be construed as limited to the forms shown which are to be considered illustrative rather than restrictive.

I claim:

1. A spring loaded compound archery bow comprising;

a bow riser having a handle portion and two ends;

a rigid limb attached to each end of said bow riser;

a spring housing mounted on each limb and each said spring housing having an elongated inner cavity extending along an inner cavity axis;

a compression spring positioned within said elongated inner cavity of each said spring housing, said compression spring extending along a linear spring axis generally coaxial with said cavity axis between a first end and a second end, said compression spring being axially compressible along said linear spring axis to produce a spring force;

a crank rotatably attached to each said spring housing for rotation thereon, each said crank having a crank arm having an end bearing against one said first end of one said spring for compressing each said spring when said crank is rotated;

a lever arm attached to each said crank and extending therefrom;

a cam rotatable attached to each said lever arm for rotation thereon; and a bow string attached between said cams for rotating each said cams and rotating each said lever arm and crank to axially compress both said compression springs along said spring axis when said bow string is pulled back for shooting an associated arrow, wherein each said spring housing is slidably mounted to each said limb along a sliding axis parallel to said linear spring axis and said each spring housing has a locking fastener to selectively lock the spring housing in a position relative to each said limb.

2. The archery bow in accordance with claim 1 further including a timing cable extending between said cams to synchronize said cams.

3. The archery bow in accordance with claim 1 wherein each said elongated inner cavity of said spring housing has a function length and said functional length defining a maximum axial length of said compression spring before said axial compression, said bow further including a spring compression adjustment for adjusting the spring force of each said spring, said spring compression adjustment changing said functional length of said elongated inner cavity.

4. The archery bow in accordance with claim 3 wherein said each spring compression adjustment includes a threaded adjustment member threadedly attached to one end of each said spring housing and configured to change said functional length of said spring housing.

5. The archery bow in accordance with claim 1 wherein each said crank arm has a roller on the end thereof, said roller having an outwardly facing roller surface and said roller surface being configured to rollingly engage a spring cap on said first end of said each spring and push against said each spring to axial compress said each spring.

6. The archery bow in accordance with claim 1 wherein each said spring has a spring cap on said first end for said crank arm to engage and push against.

7. The archery bow in accordance with claim 1 wherein each crank has a pair of parallel lever arms forming a yoke, each said cam being rotatably joined in said yoke between said parallel lever arms.

8. The archery bow in accordance with claim 7 wherein each said crank is generally L-shaped, said crank arm forming one leg of said L-shape and said yoke forming the other leg of said L-shape.

9. A spring loaded compound archery bow comprising;

a bow riser having a handle portion, a top end, a bottom end wherein said bow riser generally extends vertically between said top and bottom ends;

a first spring housing mounted relative to said top end, said first spring housing having a first elongated inner cavity extending along a first inner cavity axis;

a second spring housing mounted relative to said bottom end, said second spring housing having a second elongated inner cavity extending along a second inner cavity axis;

a first compression spring positioned within said first elongated inner cavity of said first spring housing, said first compression spring extending along a first linear spring axis between a first forward end and a first reward end, said first compression spring being axial compressible along said first linear spring axis and having a rearwardly exposed first spring end cap;

a second compression spring positioned within said second elongated inner cavity of said second spring housing, said second compression spring extending along a second linear spring axis between a second forward end and a second reward end, said second compression spring being axial compressible along said second linear spring axis and having a rearwardly exposed second end cap;

a first crank support fixed relative to said first spring housing that rotatably supports a first crank about a first support axis, said first crank having a first crank arm including a first extension spaced from said first support axis that is engagable against said first end cap when said first crank rotates about said first axis;

a second crank support fixed relative to said second spring housing that rotatably supports a second crank about a second support axis, said second crank having a second crank arm including a second extension spaced from said second support axis that is engagable against said second end cap when said second crank rotates about said second axis, said first and second axes being spaced from one another;

a first rotatable bow string support attached to said first crank for rotation thereon, said first rotatable string support having a first outwardly facing guide groove;

a second rotatable bow string support attached to said second crank for rotation thereon, said second rotatable string support having a second outwardly facing guide groove; and, a bow string joined between said first and second rotatable bow string supports and said first and second outwardly facing guide grooves being shaped to guide said bow string about said rotatable bow string supports as said supports rotate relative to said respective cranks such that when said bow string is pulled back for shooting an associated arrow, said first rotatable bow string support rotates about said first crank and said first crank rotates about said first support axis and said first extension linearly compresses said first compression spring along said first spring axis while said second rotatable bow string support rotates about said second crank and said second crank rotates about said second support axis and said second extension linearly compresses said second compression spring, the compression of said first and second compression springs providing an amount of stored energy to propel the associate arrow and one of said first and second rotatable bow string support providing at least one of increasing said amount of stored energy and reducing a holding force for the shooter when said bow is at full draw.

10. The archery bow in accordance with claim 9, wherein said first compression spring is generally transverse to said bow riser and generally parallel with said second compression spring, such that said first linear spring axis is generally parallel with said second linear spring axis over a substantial portion of their lengths.

11. The archery bow in accordance with claim 9, further including an upwardly extending first limb and a downwardly extending second limb, said first spring housing being mounted to said first limb and said second spring housing being mounted to said second limb.

12. The archery bow in accordance with claim 11, wherein said first limb extends forwardly at an upward angle and said second limb extends forwardly at a downward angle.

13. The archery bow in accordance with claim 9, wherein said first compression spring is coaxial to said first cavity axis and said second compression spring is coaxial to said second cavity axis, said first spring housing being adjustable to allow for axial adjustment of said first end cap along said first spring axis relative to said first crank arm extension, said second spring housing being adjustable to allow for axial adjustment of said second end cap along said second spring axis relative to said second crank arm extension.

14. The archery bow in accordance with claim 9, wherein said first cavity axis and said second cavity axis are generally parallel to one another and generally parallel to the alignment of the associated arrow.

15. The archery bow in accordance with claim 9, further including a first spring adjustment member to adjust the spring force of said first spring and a second spring adjustment member to adjust the spring force of said second spring.

16. The archery bow in accordance with claim 15, wherein said first and second spring adjustment members to adjust said spring force are threaded members to modify the amount of axial compression of the respective springs before said bow string is pulled back for shooting the associated arrow.

17. The archery bow in accordance with claim 15, wherein said first and second spring adjustment members to adjust said spring force are threaded members to reduce the amount of axial compression of the respective springs to allow for removal of said bow string.

18. The archery bow in accordance with claim 9, wherein said first end cap of said first compression spring extends out of a first rear side opening of said first spring housing and said second end cap of said second compression spring extends out of a second rear side opening of said second spring housing before said bow string is pulled back for shooting the associated arrow.

19. The archery bow in accordance with claim 9, wherein said first extension includes a first roller bearing having a first outwardly facing roller bearing surface that rollingly engages said first end cap when said first crank rotates about said first support axis and said second extension includes a second roller bearing having a second outwardly facing roller bearing surface that rollingly engages said second end cap when said second crank rotates about said second support axis.

20. The archery bow in accordance with claim 9, wherein said first and second rotatable bow string supports are rotatable cam supports.

21. The archery bow in accordance with claim 9, wherein said at least one of said first and second rotatable bow string support provides both increasing of said amount of stored energy and reducing the holding force for the shooter when said bow is at full draw.

22. The archery bow in accordance with claim 20, wherein both said first and second rotatable bow string supports provides both increasing of said amount of stored energy and reducing a holding force for the shooter when said bow is at full draw.

23. The archery bow in accordance with claim 9, wherein said first and second compression springs are coil springs.

24. The archery bow in accordance with claim 1, wherein said compression spring is a coil spring.

25. The archery bow in accordance with claim 9, wherein said first and second forward and reward ends of said first and second compression springs define first and second spring lengths respectively, said first and second compression spring being axially compressible along a substantial portion of said first and second lengths.

26. The archery bow in accordance with claim 1, wherein said first end and a second end of said compression spring define a spring length, said compression spring being axially compressible along a substantial portion of said spring length.

* * * * *

UNITED STATES PATENT AND TRADEMARK OFFICE

CERTIFICATE OF CORRECTION

PATENT NO. : 8,522,763 B2
APPLICATION NO. : 12/932561
DATED : September 3, 2013
INVENTOR(S) : Nebergall It is certified that error appears in the above-identified patent and that said Letters Patent is hereby corrected as shown below:

In the Claims:

Column 4, Line 34 (Claim 5, Line 8), delete “axial” and insert --axially--.

Column 4, Line 61 (Claim 9, Line 16), delete “axial” and insert --axially--.

Column 5, Line 2 (Claim 9, Line 24), delete “axial” and insert --axially--.

Column 5, Line 41 (Claim 9, Line 63), delete “associate” and insert --associated--.

Signed and Sealed this
Seventh Day of January, 2014

Margaret A. Focarino

Margaret A. Focarino
*Commissioner for Patents of the United States Patent and Trademark Office*